US005339665A

United States Patent [19]

Yoshikawa

[11] Patent Number: 5,339,665

[45] Date of Patent: Aug. 23, 1994

[54] DIE-CUSHION APPARATUS OF PRESS MACHINE

[75] Inventor: Eiji Yoshikawa, Ishikawa, Japan

[73] Assignee: Kabushiki Kaisha Komatsu Seisakusho, Japan

[21] Appl. No.: 39,318

[22] PCT Filed: Nov. 1, 1991

[86] PCT No.: PCT/JP91/01501

§ 371 Date: Apr. 23, 1993

§ 102(e) Date: Apr. 23, 1993

[87] PCT Pub. No.: WO92/07711

PCT Pub. Date: May 14, 1992

[30] Foreign Application Priority Data

Nov. 2, 1990 [JP] Japan ..... 2-295448
Nov. 2, 1990 [JP] Japan ..... 2-295449

[51] Int. Cl.[5] ..... B21D 24/14
[52] U.S. Cl. ..... 72/21; 72/351
[58] Field of Search ..... 72/21, 350, 351, 453.13

[56] References Cited

U.S. PATENT DOCUMENTS 5,009,091 4/1991 Hinterman et al. ..... 72/21
5,031,431 7/1991 Naito ..... 72/21
5,168,738 12/1992 Bielfeldt ..... 72/351

FOREIGN PATENT DOCUMENTS 0417753 3/1991 European Pat. Off. .
3807683 9/1989 Fed. Rep. of Germany .
6457926 3/1989 Japan .
6457927 3/1989 Japan .

*Primary Examiner*—Lowell A. Larson
*Attorney, Agent, or Firm*—Ronald P. Kananen

[57] ABSTRACT

The object of the present invention is to provide a die-cushion apparatus of a press machine capable of performing a preliminary acceleration imparted to a die-cushion pad following the lowering of a slide with an exact timing and high precision and being improved so as to eliminate a pressure deviation between an actual pressure in a hydraulic cylinder and a preliminarily set aimed value at a portion near a lower dead point of the slide stroke. The die-cushion apparatus is provided with a pneumatic cylinder (6), a servo valve (40) for discharge pressure control and a hydraulic cylinder (7) to which a pressurized oil is made up by suction and constructed such that the make-up of the pressurized oil to the hydraulic cylinder (7) at the preliminary acceleration is performed by a pressurized oil makeup circuit (16) provided with a servo valve (22) controlled by a control unit body (14), and a control signal from a pressure control body (27) controlling the discharge pressure control servo valve (40) is corrected in response to the slide lowering speed and the press operation speed.

2 Claims, 6 Drawing Sheets

DIE-CUSHION APPARATUS OF PRESS MACHINE

TECHNICAL FIELD OF THE INVENTION

This invention relates to a die-cushion apparatus provided for a press machine and more particularly to a control apparatus for carrying out a preliminary acceleration and pressure control of a die-cushion.

BACKGROUND ART OF THE INVENTION

In a known art, a die-cushion apparatus provided for a press has a structure which elastically supports a die-cushion pad disposed near a lower mold through a plurality of die-cushion pins and in which, when an upper mold lowering together with a slide abuts, through a work, against a blank holder to thereby apply a press load to the die-cushion pad, a pressure in a die-cushion cylinder supporting the die-cushion pad from the lower side thereof is discharged, and then the blank holder is also lowered together with the upper mold by an amount corresponding to a cushion stroke.

In the press die-cushion apparatus of the structure described above, a large colliding noise is generated when the upper mold lowering together with the slide abuts against the blank holder through the work.

For this reason, in a conventional technology, the die-cushion pad is preliminarily lowered at a speed lower than a lowering speed of the slide to thereby reduce the noise generated by the collision of the upper mold with the blank holder and hence to prevent the life times of the upper mold and the blank holder from being shortened.

In the conventional preliminarily accelerating device, the lowering speed is regulated by controlling a flow rate to a preliminarily accelerating hydraulic cylinder provided for the die-cushion by means of a servo valve.

Namely, a crank angle of the press is detected and when the crank angle reaches a preliminarily set angle, the servo valve is opened by a predetermined angle to thereby start preliminary acceleration, and when the crank angle reaches an angle at which the upper mold abuts against the blank holder, the servo valve is closed. Thus, the lowering speed control at the preliminary acceleration has been performed by an open-loop control mode.

However, in a case where the lowering speed control of the die-cushion is carried out by the above conventional open-loop control, large dispersion is caused in the lowering speed, and in the case of a large speed relative to the upper mold, such effect as the reduction of the colliding noise cannot be expected.

Further, also in a case where the die-cushion is lowered with a fast speed, not only a desired object cannot be achieved by the abutment of the upper mold against the blank holder after the preliminary acceleration, but also the normal press formation is not performed, resulting in a cause of production of defective. In addition, the setting of the angle at which the preliminary acceleration starts is to be decided through repeated trial formations, so that much time is required for the regulation of the lowering speed, thus being inconvenient.

Furthermore, in a conventional art, a die-cushion of a press utilized for drawing formation is composed of a hydraulic cylinder and a pneumatic cylinder in which pressurized oil is supplied by suction operation and the cushioning function is attained by a discharge pressure control of both the cylinders.

A die-cushion unit to be numerically controlled (NC) is connected to this hydraulic cylinder to thereby vary a cushioning capacity by controlling the servo valve for pressure discharge connected to a hydraulic cylinder in accordance with the crank angle of the press. A control unit e for controlling the servo valve has a structure, as shown in FIG. 6, for controlling a servo valve d by detecting a pressure of the hydraulic cylinder a by a pressure sensor b, comparing the detected actual pressure with a preliminarily set aimed value by a comparator c and outputting the thus obtained pressure deviation to the servo valve d by applying a constant gain to the pressure deviation.

However, in the press, the lowering speed of the press changes as shown in FIG. 8 in response to the crank angle, the lowering speed becomes zero at a lower dead point (crank angle of 180°), and the slide speed changes in response to the operation speed of the press. Further, the characteristic feature of the servo valve d controlling the hydraulic cylinder a is non-linear, and accordingly, an object to be controlled by the control unit becomes nonlinear.

For the reason described above, in the conventional control unit, the actual pressure becomes dull near the lower dead point as shown by a curve B in FIG. 7 with respect to a pressure instructed value (aimed value) shown by a curve A in FIG. 7, and a pressure difference between the aimed value and the actual pressure value becomes large and the control performance is degraded, thus being inconvenience.

SUMMARY OF THE INVENTION

This invention was conceived in consideration of the above matters and aims to provide a die-cushion apparatus of a press machine capable of, in order to weaken an impact of an upper mold to a blank holder through a work in abutment therebetween, carrying out a preliminary acceleration of a die-cushion pad following to the lowering of a slide with an exact timing and high performance. This is the first object.

The second object of the present invention is to provide a die-cushion apparatus of a press machine being improved so as to substantially eliminate pressure deviation between an actual pressure in a hydraulic cylinder and a preliminarily set aimed value at a portion near a lower dead point of a slide stroke.

To achieve the above first object, according to the first embodiment of the present invention, there is provide a die-cushion apparatus for a press machine including a pneumatic cylinder attaining a cushioning function and a hydraulic cylinder enabling and locking cushioning capability, the die-cushion apparatus comprising a pressurized oil makeup circuit for making up a pressurized oil to the hydraulic cylinder at a preliminary acceleration period of a die-cushion following a lowering motion of a slide, a servo valve disposed to the pressurized oil makeup circuit, and a control unit body, in order to control the servo valve, for calculating a crank angle for preliminary acceleration starting and a crank angle for preliminary acceleration finishing in response to a preliminary acceleration stroke value, a drawing stroke value and a press operation speed value inputted through an operation panel, for comparing an aimed value inputted into a comparator with respect to the respective crank angles outputted from a crank angle detector with data relating a die-cushion stroke outputted from a dis-cushion stroke position detector and for controlling the servo valve in a feedback mode so as to eliminate deviation when the deviation is caused between the aimed value and the data.

In order to achieve the second object of the present invention, there is provided a die-cushion apparatus for a press machine comprising a pneumatic cylinder attaining a cushioning function, a hydraulic cylinder having a pressure discharge line connected to a discharge pressure controlling servo valve to enable and lock a cushioning capability, a pressure detector disposed to the pressure discharge line between the hydraulic cylinder and the servo valve for detecting an actual pressure of the hydraulic cylinder, and a pressure control unit for comparing in calculation the actual pressure detected by the pressure detector and a pressure instruction value generated from a pressure generator and for controlling the servo valve so as to make coincident the actual pressure with the pressure instruction value in response to the deviation between the actual pressure and the pressure instruction value, the die-cushion apparatus further comprising means for detecting a lowering speed of a slide of a press and an operation speed of the press and outputting signals representing the detected lowering speed and the operation speed of the press and means for correcting an output signal from the pressure control unit for controlling the servo valve in response to the detected signals.

According to the die-cushion apparatus of the present invention including the above embodiments, since the acceleration speed of the die-cushion can be precisely controlled so as to obtain an aimed value outputted with respect to every crank angle, the colliding noise generated in an abutment of the upper mold against the blank holder can be effectively reduced and the drawing amount can be also ensured exactly, thus preventing the defective from producing.

Moreover, since the preliminary acceleration starting angle and its finishing angle can be automatically calculated only by inputting the preliminary acceleration stroke and drawing stroke of the die-cushion pad in accordance with the mold, any troublesome adjustment is not required, thus improving the maneuverability.

Furthermore, since the control signal outputted from the pressure control unit controlling the pressure discharge servo valve by considering the slide lowering speed and the press operation speed, which are factors for the non-linearlity of the object to be controlled, as parameters for the hydraulic pressure control in the hydraulic cylinder, the servo valve can be controlled by the control signal corrected so as to keep the pressure near the preliminarily set aimed value at a portion near the lower dead point at which the slide speed becomes slow, that is, to make small the gain of the integrated circuit. Accordingly, the pressure control characteristic in the hydraulic cylinder can be remarkably improved so as to make small the dullness of the actual pressure at the portion near the lower dead point and the production performance of the product can be remakably improved.

The above and other objects, embodiments and advantages of the present invention will be made clear to persons skilled in the art from the following descriptions and accompanying drawings showing preferred embodiments coinciding with the principle of the present invention.

DETAILED DESCRIPTION OF THE PREFERRED EMBODIMENTS

Hereinbelow, two typical embodiments of the present invention will be described in conjunction with the accompanying drawings (FIGS. 1 to 5).

Figure 1:
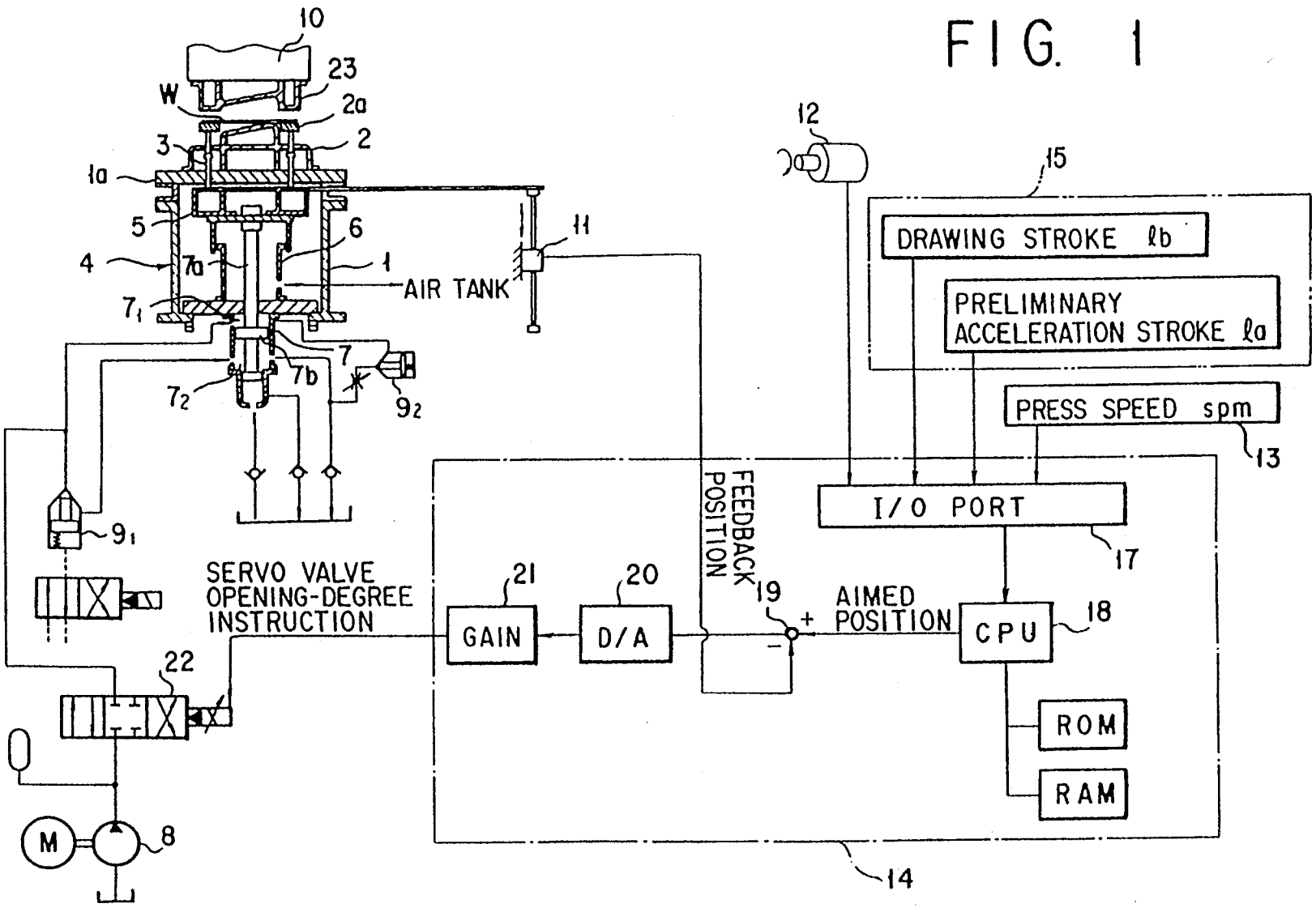
FIG. 1 is a view showing a schematic structure representing a first embodiment of the present invention.
Figure 2:
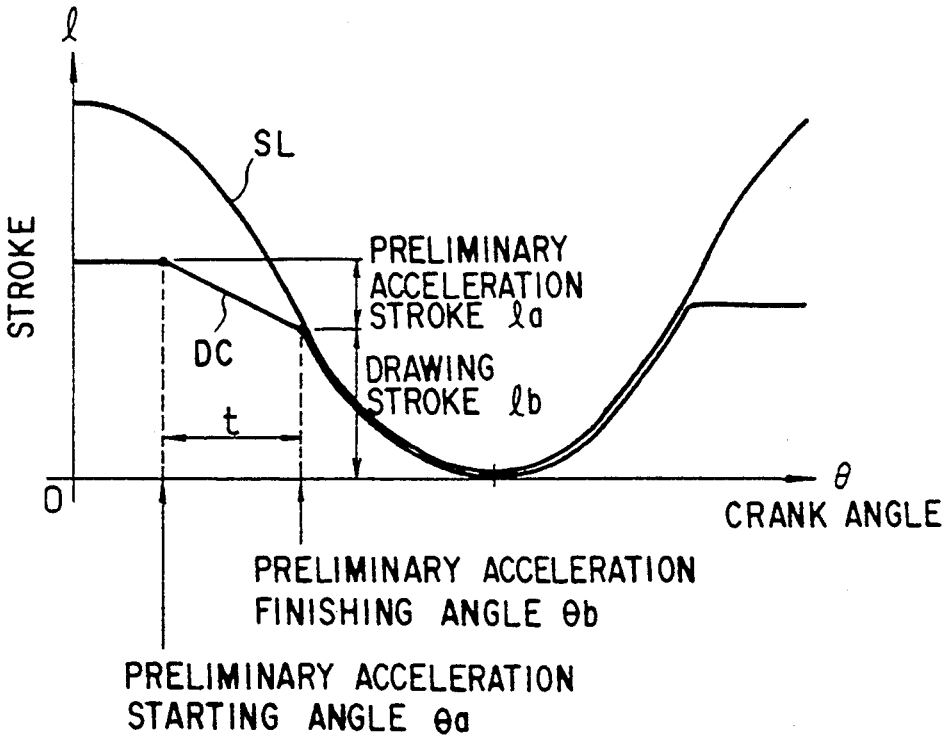
FIGS. 2 and 3 are views both for the explanatory of operation of the first embodiment.
Figure 3:
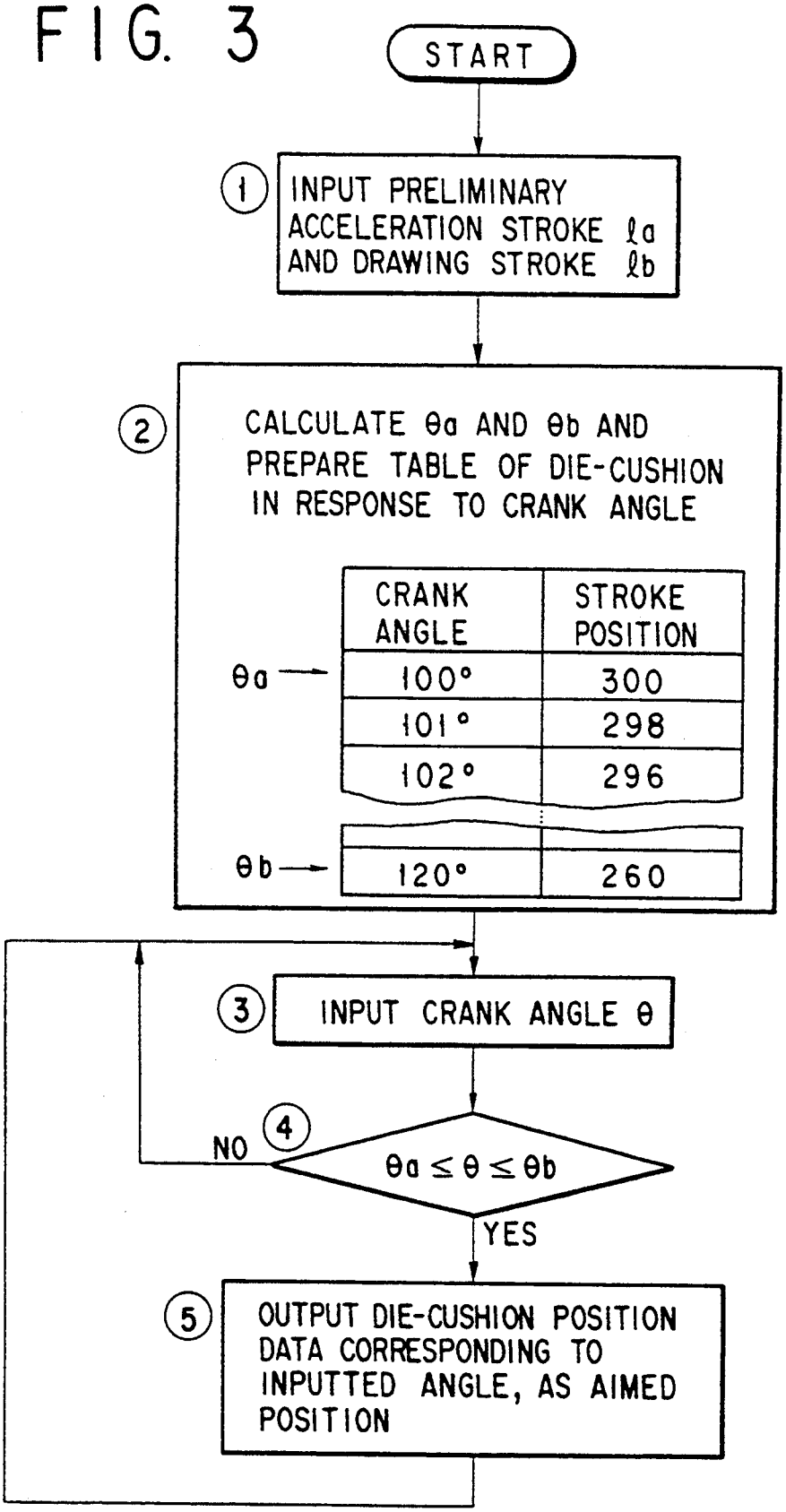

First, FIGS. 1 to 3 represent a first embodiment of the present invention. Referring to FIG. 1, reference numeral 1 denotes a press machine body, in which a lower mold half 2 is mounted on a bolster 1*a* and a blank holder 2*a* disposed to the peripheral portion of the lower mold 2 is elastically supported by a die-cushion 4 through a plurality of die-cushion pins 3 disposed in the bolster 1*a*.

This die-cushion 4 comprises a die-cushion pad 5 supporting the respective die-cushion pins 3 from the lower side thereof, a pneumatic cylinder 6 supporting the die-cushion pad 5 and a hydraulic cylinder 7 connected to the die-cushion pad 5 through a piston rod 7*a*.

The inside of the hydraulic cylinder 7 is divided into an upper chamber $7_1$ and a lower chamber $7_2$ by means of a piston 7*b* mounted to the piston rod 7*a*. A pressurized oil is supplied into both the chambers $7_1$ and $7_2$ through a pressurized oil makeup circuit 16 including a hydraulic pump 8 and a servo valve 22, and both the chambers $7_1$ and $7_2$ are communicated with each other through a logic valve $9_1$.

Reference numeral $9_2$ denotes a locking valve incorporated in a discharge circuit of the upper and lower chambers $7_1$ and $7_2$.

A stroke position of the die-cushion pad 5 is detected by a die-cushion stroke position detector 11 and is inputted into a control unit body 14.

In the control unit body 14, there are inputted, by means of, for example, an operation panel 15, a crank angle ($\gamma$) detected by a crank angle detector 12 connected to a main shaft (not shown) of the press machine body 1, a pressing speed (spm) detected by a rotation detector 13 detecting rotation of a main motor (not shown) and drawing stroke 1*b* and preliminary acceleration stroke 1*a* of a work W separately formed.

The data inputted from the respective detectors 12 and 13 and the operation panel 15 are then inputted, through an I/O port 17, into a caluculation processing unit 48, in which a preliminary acceleration starting angle $\theta$ a and finishing angle $\theta$ b (see FIG. 2) are calculated in accordance with the data preliminarily stored in memory ROM and RAM and the calcualted data are then outputted to a comparator 19.

To the comparator 19 is inputted a present die-cushion position from the die-cushion position detector 11 and the present die-cushion position is compared with the aimed value outputted from the calculation processing unit 18. In this comparison, the deviation is outputted to a solenoid of the servo valve 22 as a serve valve opening degree instruction signal through a D/A converter 20 and a gain set circuit 21, thereby controlling the servo valve 22.

The operation will be described hereunder.

A die-cushion motion is represented by a curve DC in FIG. 2 with respect to a slide motion shown by a curve SL. When the preliminary acceleration of the die-cushion is started with the crank angle $\theta$ a, the upper mold 23 secured to the slide 10 abuts against the blank holder 2*a* with the crank angle $\theta$ b, thus completing the preliminary acceleration.

Further, at this moment, the preliminary acceleration stroke becomes 1*a* and the drawing stroke becomes 1*b*, which are know values though being variable in accordance with the work W to be formed.

In the formation of the work W, the preliminary acceleration stroke 1*a* and the throttle stroke 1*b* are first inputted as represented by step (1) in the flowchart of FIG. 3.

In the control unit body 14, the calculation processing unit 18 calculates the preliminary acceleration starting angle $\theta$ a and finishing angle $\theta$ b in the step (2) in accordance with the data regarding the strokes 1*a* and 1*b*.

Namely, supposing that the slide speed at the formation time is v, the v is shown as $$u = f'v\,(\theta, spm) = spm \cdot fv(\theta)$$

in which spm represents a stroke/min.

$\theta$=fe (l) and fv ($\theta$) is a function relating to a speed at 1 spm. From the above, the preliminary acceleration starting angle $\theta$ a and the acceleration finishing angle $\theta$ b will be calculated as follows.

$$la = (1/k)\ v \cdot t$$

$$t = k \cdot la/spm \cdot fv\ (\theta\ b) \qquad (1)$$

$$t = 60\ \text{sec}/spm \times (\theta\ b - \theta\ a)/360^\circ$$

$$\theta a = \theta\ b - 6 \cdot spm \cdot t \qquad (2)$$

When the equation (1) is applied to the equation (2), $$\begin{aligned} \theta a &= \theta b - 6 \cdot spm \cdot k \cdot la/spm \cdot fv(\theta b) \\ &= \theta b - 6 \cdot k \cdot la/fv(\theta b) \end{aligned}$$

Accordingly, $\theta$ b=f l (l b) and $$\theta a = \theta b - k \cdot 6 \cdot l\ a/fv\ (\theta\ b)$$

In the above equations, the symbol k (1<k) is a coefficient and the die-cushion is pin-touched at the speed of 1/k of the slide lowering speed (the upper mold abuts against the blank holder).

According to the preliminary acceleration starting and finishig angles $\theta$ a and $\theta$ b, caluculated above, a table representing the stroke positons of the die-cushion stroke with respect to the crank angle is preliminarily prepared and the table is stored in the memory RAM.

Thereafter, when the pressing working is started, in response to the lowering of the slide 10, the crank angle is inputted into the control unit body 14 by the crank angle detector 12 and the slide speed is also inputted therein by the press speed detector 13 (step (3)). In the step (4), the calculation processing unit 18 of the control unit body 14 discriminates $\theta$ a$\leqq\theta\leqq\theta$ b, and in this discrimination, in the case of YES, the process advances to the step (5) to read out the die-cushion stroke data position every crank angle from the table stored in the memory RAM and then to output the data to the comparator 19 as the aimed position.

In the meantime, when the crank angle reaches the preliminary acceleration starting angle, the servo valve 22 is opened in response to the servo starting instruction signal so that the pressurized oil flows in the upper chamber 7, of the hydraulic cylinder 7 and the die-cushion pad 5 starts to the preliminary acceleration (lowering). At this moment, the acceleration stroke of the die-cushion pad 5 is inputted from the die-cushion stroke position detector 11 into the comparator 19, in which it is compared with the aimed position outputted from the calculation processing unit 18, thereby calculating the deviation therebetween.

Then, the servo valve 22 is subjected to the feedback control so that the deviation becomes zero (0).

Accordingly, the die-cushion pad 5 can be accelerated with precise timing always in accordance with the aimed position and the upper mold 23 abuts against the blank holder 2*a* at the position when the die-cushion pad 5 lowers with the preliminary acceleration stroke 1*b*, then finishing the preliminary acceleration.

Thereafter, the slide 10 continues to lower and the work W is then subjected to the drawing working between the upper and lower molds 23 and 2. When the slide reaches the lower dead point, the formation has been completed and the slide 10 raises by the actuation of the pneumatic cylinder 6, thus the die-cushion pad 5 also starting to raise.

Further, as occasion demands, the raising of the die-cushion pad 5 can be locked by the actuation of the hydraulic cylinder 7 when the servo valve 22 is closed.

A second embodiment of the present invention will be described hereunder with reference to FIGS. 4 and 5.

Further, the construction near the die-cushion 4 in the second embiodiment is substantially the same with that of the first embodiment, so that the detailed description thereof is omitted herein by adding the same reference numerals for avoiding duplication.

Figure 4:
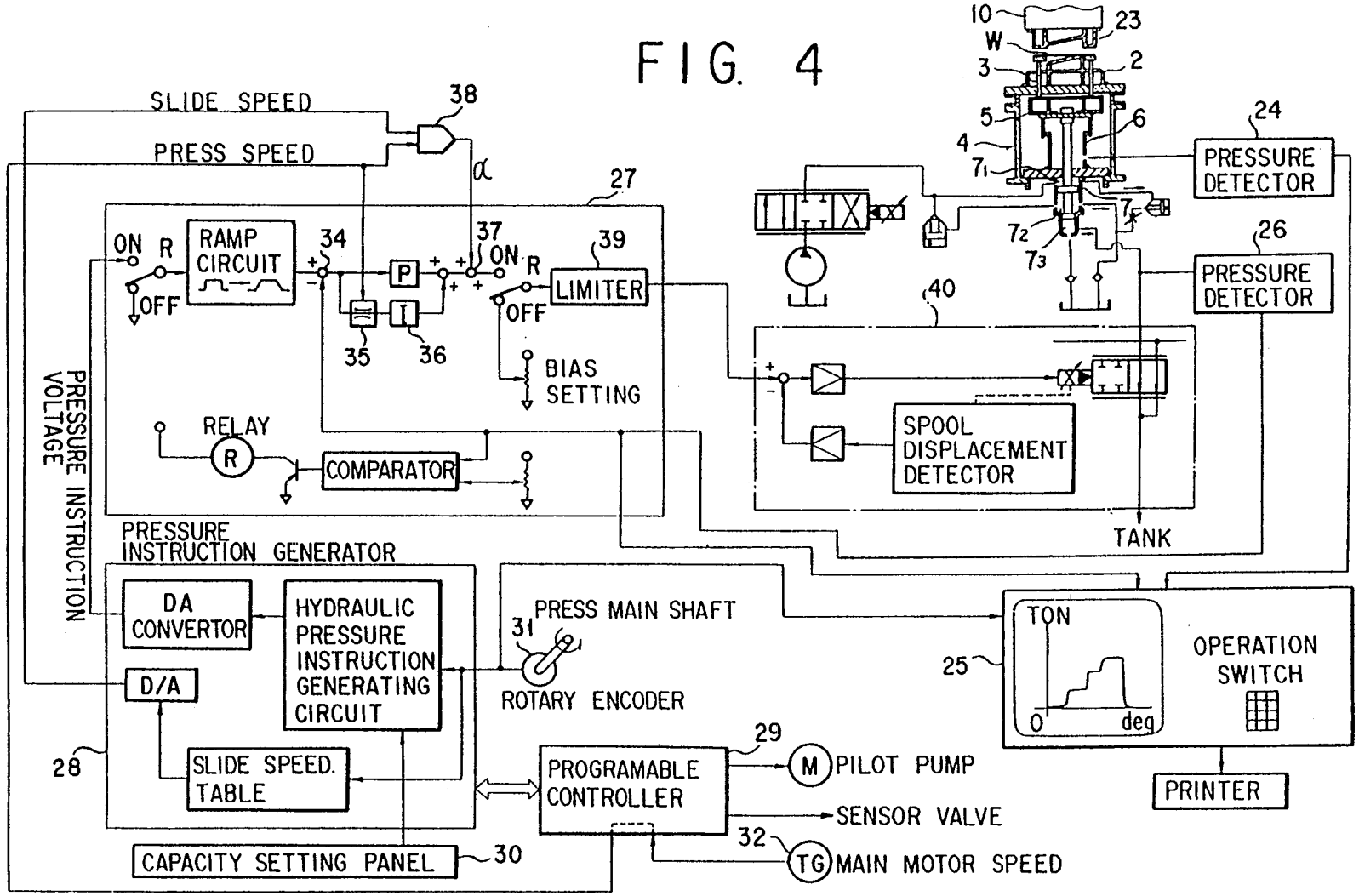
FIG. 4 is a view showing a schematic structure representing a second embodiment of the present invention.

Referring to FIG. 4, the die-cushion 4 comprises the pneumatic cylinder 6 elastically supporting the die-cushion pad 5 and the hydraulic cylinder 7. The pressure inside the pneumatic cylinder 6 is detected by the pressure detector 24 and the detected value is transferred to a display unit 25 and, on the while, the pressure inside the hydraulic cylinder 7 is detected by the pressure detector 26 and the detected value is inputted to the comparator 34 of a pressure control unit body 27.

A pressure control unit comprises this control unit body 27, a pressure instruction generator 28 for inputting a pressure instruction voltage to the control unit body 27 and a programable controller 29, and a die-cushion capacity pattern is inputted into the pressure instruction generator 28 from a capacity setting panel 30.

Further, the rotation angle (crank angle) of the main shaft of the press machine, not shown, is inputted into the pressure instruction generator 28 through a rotary encoder 31, and a rotation angle of the main motor, not shown, is inputted into the programable controller 29 through the rotation speed detector 32.

The pressure control unit body 27 includes a multiplicator 35 and an integrator 36 both connected to the output side of the comparator 34. An output from the integrator 36 is outputted from a comparator 37, to a servo motor 40 through a limiter 39 after the correction by a corrected value from a multiplicator 38, described hereinlater, to thereby control a hydraulic pressure to be drained to a tank from a pressure chamber $7_3$ of the hydraulic cylinder 7 through the servo motor 40.

Next, the operation will be described. The factors for the non-linear control object reside in the change of the slide angle in response to the crank angle and the change of the slide speed, for example, to 1–14 SPM (slide/min.) in response to the operation speed.

In consideration of this matter, according to the present invention, the correction can be performed by inputting the lowering speed of the slide and the operation speed of the press into the control unit body 27.

Namely, in response to the crank angle inputted from the rotary encoder 31 to the pressure instruction generator 28, the slide speed with respect to each crank angle is read out from the speed table preliminarily set in the slide speed table and then D/A converted and inputted into the multiplicator 38.

The press speed is inputted from the programable controller 29 to the multiplicator 38 in response to the signal from the rotation detector 32 detecting the rotation of the main motor, and the correction value is calculated by the multiplicator 38 and then outputted to the comparator 37.

Figure 5:
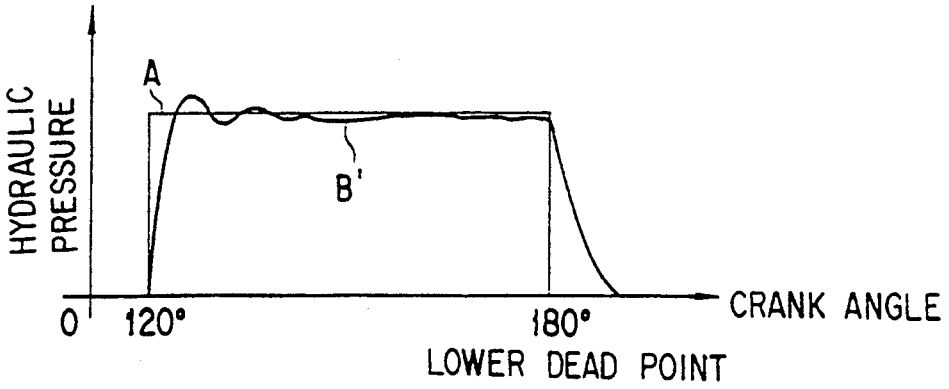
FIG. 5 is a view for the explanatory of operation of the second embodiment.
Figure 7:
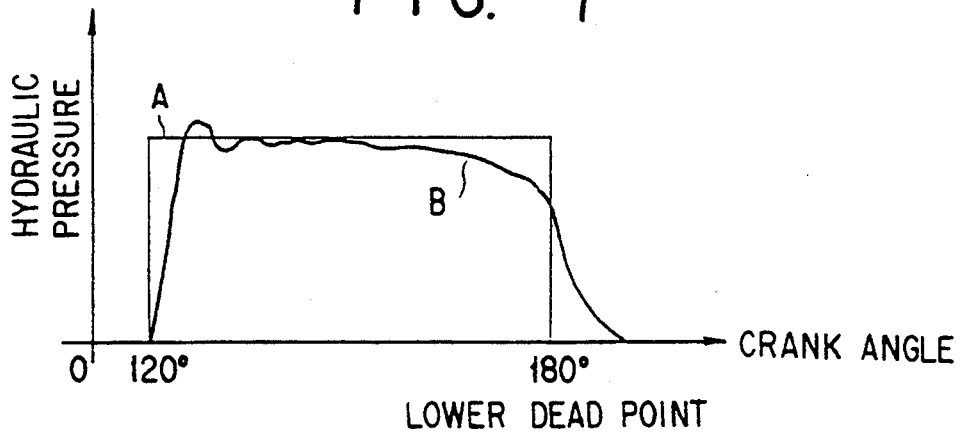
FIGS. 7 and 8 are views for the explanatory of operation of the conventional example.
Figure 8:
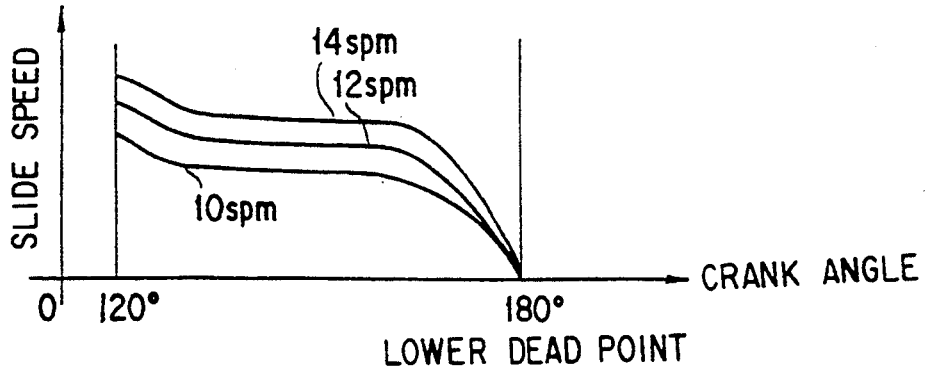
Figure 6:
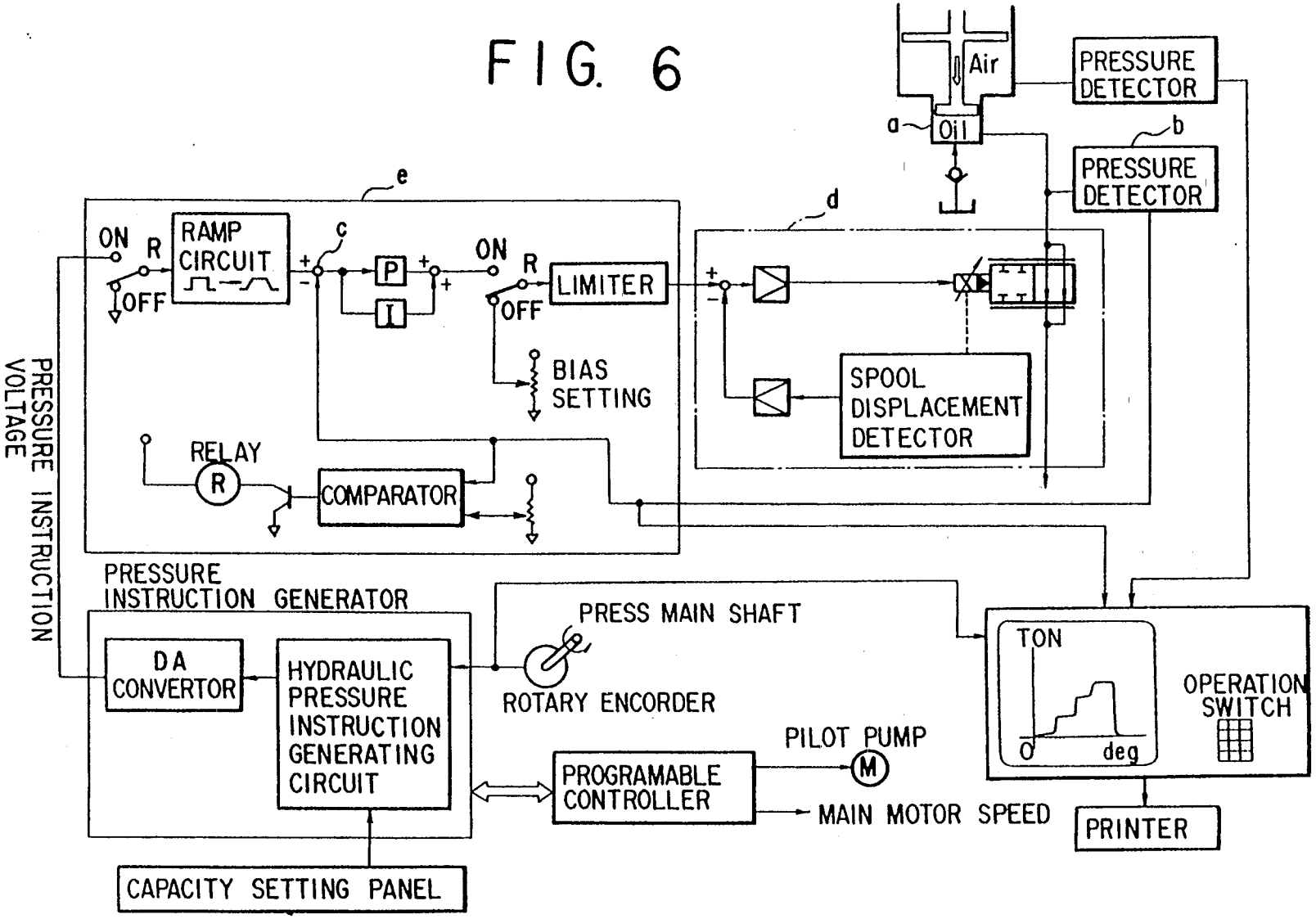
FIG. 6 is a view showing a schematic structure of a conventional example.

On the other hand, the control unit body 27 controls the servo motor 4θ along the line A of FIG. 5 in accordance with the pressure instruction based on the pressure instruction voltage from the pressure instruction generator 28.

Namely, the upper mold 23 starts to lower from the upper dead point of the slide, and when the crank angle becomes 120°, for example, the upper mold 23 contacts the blank holder 5 through the work W, and then the pressure is applied to the die-cushion 4. At this time, the servo motor 40 is controlled so that a pressure is generated along the pressure instruction curve A in the pressure chamber $7_3$ of the hydraulic cylinder 7.

Thereafter, according to the progress of the formation, the pressure in the pressure chamber $7_3$ of the hydraulic cylinder 7 is drained to the tank through the servo valve 40 to thereby maintain constant the pressure in the pressure chamber $7_3$ of the hydraulic cylinder 7 and also to correct the control signal to be outputted to the servo motor in proportion to the slide lowering speed in accordance with the correction value ($\alpha$) which has been inputted into the comparator 37 from the multiplicator 38.

That is, when the slide lowering speed is small, the correction is made to close the servo valve 40, whereas when the slide lowering speed becomes large, the correction is made to open the servo valve 40.

At the same time, the press operation speed outputted from the programable controller 29 is inputted into the multiplicator 35 to thereby correct a gain of the integrator 36.

Namely, when the slide lowering speed is small, the correction is made to also make small the gain, whereas when the slide lowering speed becomes large, the correction is made to also make large the gain.

According to the above operation, when the slide lowers to a position near the lower dead point to make small the slide lowering speed, the servo valve 40 is controlled to be closed and also to make small the gain of the integrator 36, so that any dullness of an actual pressure is substantially not found at a portion near the lower dead point and hence the actual pressure B′ can be controlled along the pressure instruction curve A.

For the sake of confirmation, in the use of a conventional pressure control apparatus, there was observed 10–15% dullness with respect to the pressure instruction, but according to the pressure control apparatus of the present invention, the dullness could be reduced lower than 2%.

I claim:

1. A die-cushion apparatus for a press machine including a pneumatic cylinder attaining a cushioning function and a hydraulic cylinder enabling and locking cushioning capability, the die-cushion apparatus comprising a pressurized oil makeup circuit for making up a pressurized oil to said hydraulic cylinder at a preliminary acceleration period of a die-cushion following a lowering motion of a slide, a servo valve disposed to said pressurized oil makeup circuit, and a control unit body for calculating a crank angle for preliminary acceleration starting and a crank angle for preliminary acceleration finishing in response to a preliminary acceleration stroke value, a drawing stroke value and a press operation speed value inputted through an operation panel, for comparing an aimed value of the stroke position of the die-cushion inputted into a comparator with respect to the respective crank angles outputted from a crank angle detector with data relating a die-cushion stroke outputted from a die-cushion stroke position detector and for controlling said servo valve in a feed back mode so as to eliminate deviation when the deviation is caused between the aimed value and the data.

2. A die-cushion apparatus for a press machine comprising a pneumatic cylinder attaining a cushioning function, a hydraulic cylinder having a pressure discharge line connected to a discharge pressure controlling servo valve to enable and lock a cushioning capability, a pressure detector disposed to the pressure discharge line between the hydraulic cylinder and the servo valve for detecting an actual pressure of the hydraulic cylinder, and a pressure control unit for comparing in calculation the actual pressure detected by said pressure detector and a pressure instruction value generated from a pressure generator and for controlling said servo valve so as to make coincident the actual pressure with the pressure instruction value in response to the deviation between the actual pressure and the pressure instruction value, said die-cushion apparatus further comprising means for detecting a lowering speed of a slide of a press and a operation speed of the press and outputting signals representing the detected lowering speed and the operation speed of the press and means for correcting an output signal from said pressure control unit for controlling said servo valve in response to the detected signals.

* * * * *